US007917079B2

(12) United States Patent
Yoshioka

(10) Patent No.: US 7,917,079 B2
(45) Date of Patent: Mar. 29, 2011

(54) RECORDING MATERIAL CHARGING APPARATUS AND IMAGE FORMING APPARATUS

(75) Inventor: Tomoaki Yoshioka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 733 days.

(21) Appl. No.: 11/889,269

(22) Filed: Aug. 10, 2007

(65) Prior Publication Data

US 2008/0181697 A1 Jul. 31, 2008

(30) Foreign Application Priority Data

Jan. 31, 2007 (JP) ..... P2007-020805

(51) Int. Cl.
*G03G 15/16* (2006.01)

(52) U.S. Cl. ..... 399/390

(58) Field of Classification Search ..... 399/390; 101/390; *G03G 15/16*
See application file for complete search history.

(56) References Cited

U.S. PATENT DOCUMENTS

| | | | | |
|---|---|---|---|---|
| 4,949,132 | A * | 8/1990 | Chimoto | 399/331 |
| 5,113,226 | A | 5/1992 | Tadokoro et al. | 355/273 |
| 5,585,906 | A | 12/1996 | Takahashi et al. | 355/273 |
| 6,027,200 | A * | 2/2000 | Takahashi et al. | 347/19 |
| 6,337,962 | B1 * | 1/2002 | Inoue et al. | 399/111 |
| 2001/0026709 | A1 * | 10/2001 | Hara et al. | 399/174 |
| 2002/0057933 | A1 | 5/2002 | Ebihara et al. | 399/303 |
| 2003/0063916 | A1 * | 4/2003 | Katayanagi et al. | 399/44 |
| 2004/0213608 | A1 * | 10/2004 | Sakuma et al. | 399/388 |
| 2008/0008487 | A1 * | 1/2008 | Furuya | 399/51 |

FOREIGN PATENT DOCUMENTS

| | | |
|---|---|---|
| JP | 2005-49566 | 2/2005 |
| JP | A-2005-134745 | 5/2005 |
| JP | A-2006-78883 | 3/2006 |

* cited by examiner

*Primary Examiner* — Judy Nguyen
*Assistant Examiner* — Jennifer Simmons
(74) *Attorney, Agent, or Firm* — Morgan, Lewis & Bockius LLP

(57) ABSTRACT

A recording material charging apparatus comprises: a pre-transcription charging section arranged between a transcribing section that transcribes a toner image retained by a toner image retaining body on a recording material having concavity and convexity and a conveying section that conveys the recording material to the transcribing section and is arranged closest to the transcribing section, the pre-transcription charging section charging the recording material that is to be conveyed to the transcribing section; and a voltage supplying section that supplies voltage of a polarity opposite to a charging polarity of the toner image retained in the toner image retaining body to the pre-transcription charging section.

10 Claims, 11 Drawing Sheets

FIG. 7

| | LETHAC 66 151g/m$^2$ | | LETHAC 66 203g/m$^2$ | | LETHAC 66 250g/m$^2$ | |
|---|---|---|---|---|---|---|
| | WATER CONTENT 4% | WATER CONTENT 6% | WATER CONTENT 4% | WATER CONTENT 6% | WATER CONTENT 4% | WATER CONTENT 6% |
| WITHOUT HEAT PROCESSING | ○ | × | × | × | × | × |
| HEAT PROCESSING 125°C | ○ | ○ | ○ | × | × | × |
| HEAT PROCESSING 145°C | ○ | ○ | ○ | ○ | ○ | ○ |

○: INTENDED DEFECT OF IMAGE IS NOT GENERATED
×: INTENDED DEFECT OF IMAGE IS GENERATED

FIG. 9

| | DISTANCE FROM PRE-TRANSCRIPTION CHARGING ROLL TO MIDDLE TRANSCRIPTION BELT | | | | |
|---|---|---|---|---|---|
| | 2mm | 4mm | 6mm | 8mm | 10mm |
| WITHOUT SHIELDING MEMBER | × | × | × | ○ | ○ |
| WITH SHIELDING MEMBER | ○ | ○ | ○ | ○ | ○ |

○ : INTENDED DEFECT OF IMAGE IS NOT GENERATED

× : INTENDED DEFECT OF IMAGE IS GENERATED

FIG. 11

| | LETHAC 66 203g/m$^2$ WATER CONTENT 4% | | LETHAC 66 203g/m$^2$ WATER CONTENT 6% | |
|---|---|---|---|---|
| | CONTROL TEMPERATURE 125°C | | CONTROL TEMPERATURE 145°C | |
| | WITHOUT HEAT SHIELDING MEMBER | WITH HEAT SHIELDING MEMBER | WITHOUT HEAT SHIELDING MEMBER | WITH HEAT SHIELDING MEMBER |
| 1000 SHEETS | ○ | ○ | ○ | ○ |
| 5000 SHEETS | ○ | ○ | ○ | ○ |
| 10000 SHEETS | ○ | ○ | × | ○ |
| 20000 SHEETS | ○ | ○ | × | ○ |
| 30000 SHEETS | ○ | ○ | × | ○ |
| 40000 SHEETS | ○ | ○ | × | ○ |
| 50000 SHEETS | ○ | ○ | × | ○ |

○: INTENDED DEFECT OF IMAGE IS NOT GENERATED

×: INTENDED DEFECT OF IMAGE IS GENERATED

RECORDING MATERIAL CHARGING APPARATUS AND IMAGE FORMING APPARATUS

CROSS-REFERENCE TO RELATED APPLICATIONS

This application is based on and claims priority under 35 USC 119 from Japanese Patent Application No. 2007-020805 filed Jan. 31, 2007.

BACKGROUND (i) Technical Field

The present invention relates to a recording material charging apparatus and an image forming apparatus such as a copier and a printer.

(ii) Related Art

An image forming apparatus such as a copier and a printer can use not only a general copier paper but also a special paper such as a paper imaging a leathery pattern having premium accents and a Japanese-paper flavor as a recording material. However, such a special paper has an inconvenience that it is difficult for a transcription of a toner image to carry out evenly because concavo-convex patterns are formed on its surface in order to have premium accents.

Therefore, as an art for forming an excellent image for the recording material having the concavo-convex pattern formed, for example, one for decreasing roughness of a surface of a sheet by using a white toner or a transparent toner in advance before forming an image by a color toner (for example, refer to JP-A-2006-78883 (PP. 5 to 6)) and one for giving oscillation when transcribing a toner image on a sheet (for example, refer to JP-A-2005-134745 (PP. 7 to 8)) or the like have been known.

SUMMARY

According to an aspect of the invention, there is provided a recording material charging apparatus comprising: a pre-transcription charging section arranged between a transcribing section that transcribes a toner image retained by a toner image retaining body on a recording material having concavity and convexity and a conveying section that conveys the recording material to the transcribing section and is arranged closest to the transcribing section, the pre-transcription charging section charging the recording material that is to be conveyed to the transcribing section; and a voltage supplying section that supplies voltage of a polarity opposite to a charging polarity of the toner image retained in the toner image retaining body to the pre-transcription charging section.

BRIEF DESCRIPTION OF THE DRAWINGS

Exemplary embodiments of the present invention will be described in detail based on the following figure, wherein:

FIG. 7 is a view showing a result of checking if a defect of an image is generated or not from a viewpoint of a transfer defect in the concave portion of the paper P by using a paper of LETHAC 66 of 151 g/m$^2$, a paper of LETHAC 66 of 203 g/m$^2$, and a paper of LETHAC 66 of 250 g/m$^2$ that are adjusted into a water content of 6% and those paper that are adjusted into a water content of 4%;

FIG. 9 is a view comparing a quality of an image depending on dispersal to the pre-transcription charging roll of the toner in the case of changing a distance between the middle transcription belt and the pre-transcription charging roll;

FIG. 11 is a view comparing a quality of an image due to an unevenness of transfer when an amount of heat radiated from the pre-transcription heating roll is changed by changing the surface temperature on the pre-transcription heating roll.

DETAILED DESCRIPTION

Hereinafter, with reference to the attached drawings, the exemplary embodiments of the present invention will be described in detail.

First Exemplary Embodiment

Figure 1:
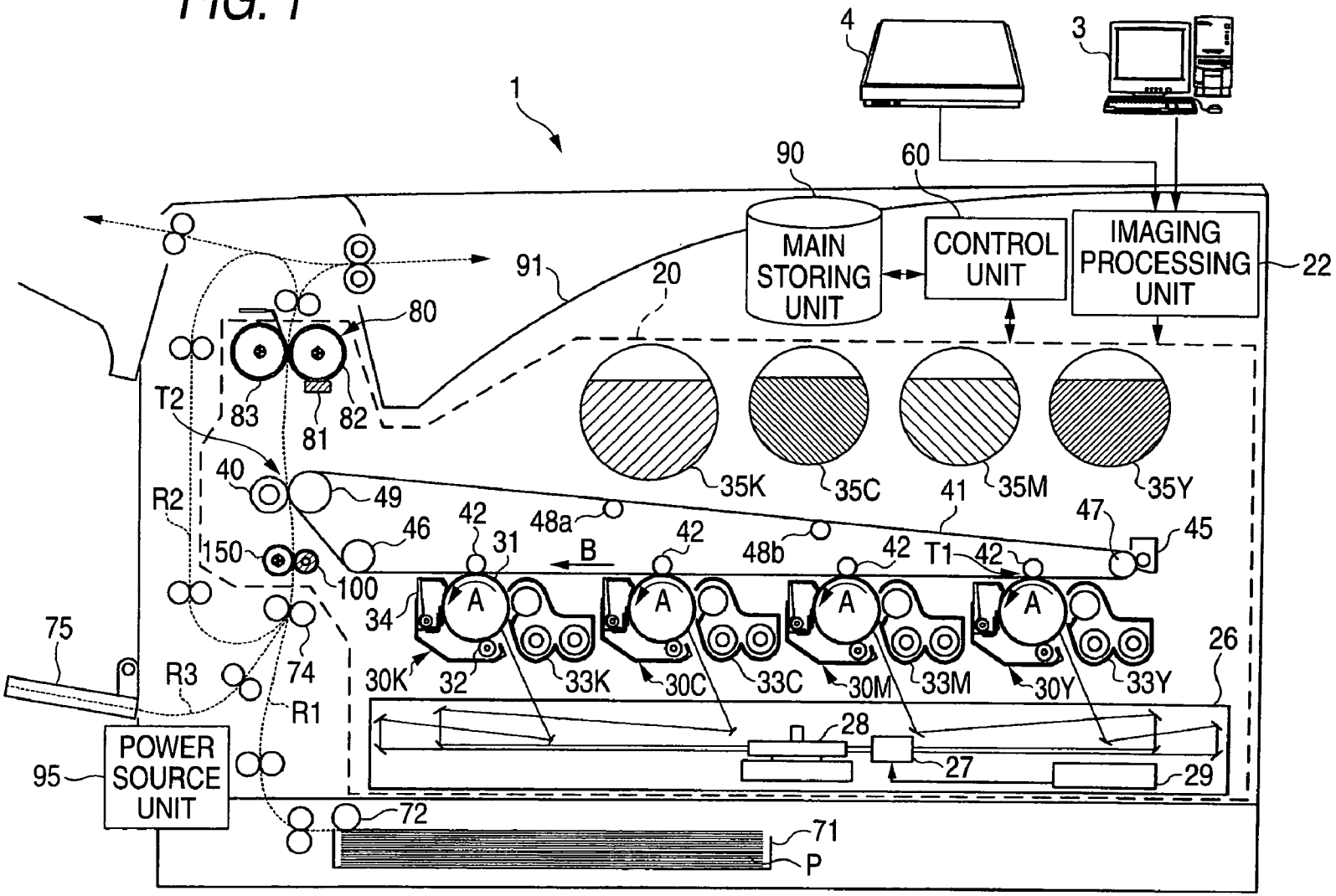
FIG. 1 is a view showing an example of the constitution of an image forming apparatus according to the present invention.

FIG. 1 is a view showing an example of the constitution of an image forming apparatus 1 to which the exemplary embodiment of the present invention is applied. The image forming apparatus 1 shown in FIG. 1 is a digital color printer of a so-called tandem type and the image forming apparatus 1 is provided with an image forming process unit 20 for forming an image corresponding to the image data of each color; a control unit 60 for controlling the operation of the image forming apparatus 1; an image processing unit 22 for providing predetermined image processing to the image data that is received from an outside apparatus, for example, a PC (a personal computer) 3 and an image reading apparatus 4 or the like; a main storing unit 90 that is realized by, for example, a Hard Disk Drive in which a processing protocol or the like is recorded; and a power source unit 95 for supplying a power to each unit.

The image forming process unit 20 is provided with four image forming units 30Y, 30M, 30C, and 30K forming toner images of yellow (Y), magenta (M), cyan (C), and black (K) that are arranged in parallel at regular intervals, respectively (these units are named generally as "an image forming unit 30").

The image forming unit 30 is provided with a photosensitive drum 31 as an example of a toner image retaining body on which an electrostatic latent image is formed while rotating in an arrow A direction; a charging roll 32 for charging a surface of the photosensitive drum 31 at a predetermined potential; a developing unit 33 for developing an electrostatic latent image that is formed on the photosensitive drum 31; and a drum cleaner 34 for cleaning the surface of the photosensitive drum 31 after a primary transcription.

The charging roll 32 is composed of a roll member that a conductive elastic body layer and a conductive surface layer are laminated in series on a core metal made of aluminum and stainless steel or the like. Then, supplied with a charging bias from a charging power source (not illustrated) that is provided within the power source unit 95, the charging roll 32 evenly charges the surface of the photosensitive drum 31 at a predetermined voltage while dependently rotating for the photosensitive drum 31.

The developing unit 33 is formed as developing units 33Y, 33M, 33C, and 33K for developing respective color toners such as yellow (Y), magenta (M), cyan (C), and black (K), respectively, on each image forming unit 30. Each developing unit 33 may develop an electrostatic latent image on the photosensitive drum 31 by holding a binary developing agent made of each color toner and a magnetic carrier and applying a direct voltage or a developing bias that a direct voltage is superimposed on an alternative voltage to the developing roll. In addition, respective developing units 33 are connected by toner containers 35Y, 35M, 35C, and 35K for storing respective color toners and a toner conveying path (not illustrated), and respective developing units 33, are configured so that a toner is supplied by a screw for supplying (not illustrated) that is disposed in the toner carriage path.

The drum cleaner 34 is configured so that a cleaning blade made of a polyurethane rubber or the like contacts the photosensitive drum 31 across an axial direction in a direction opposed to a rotational direction of the photosensitive drum 31 (namely, "a counter direction"). Then, the drum cleaner 34 may remove the toner remaining on the surface of the photosensitive drum 31.

Further, the image forming process unit 20 is provided with a laser exposure apparatus 26 for exposing each photosensitive drum 31 that is disposed to each image forming unit 30; a middle transcription belt 41 as an example of the toner image retaining body on which each color toner image formed on each photosensitive drum 31 of each image forming unit 30 is multiply-transcribed; a primary transcription roll 42 for transcribing (primarily transcribing) each toner image of each image forming unit 30 on the middle transcription belt 41 by a primary transcribing portion T1 in series; a secondary transcription roll 40 as an example of a transcribing section for collectively transcribing (secondarily transcribing) a superimposed toner image transcribed on the middle transcription belt 41 on a paper P that is a recording material (a recording paper) by a secondary transcribing portion T2; a pre-transcription charging roll 100 as an example of a pre-transcription charging section for charging the paper P before proceeding into the secondary transcribing portion T2; a pre-transcription heating roll 150 as an example of a pre-transcription heating section for heating the paper P before proceeding into the secondary transcribing portion T2, which is arranged contacting the pre-transcription charging roll 100 by pressurizing; and a fixing apparatus 80 for fixing the secondarily-transcribed image on the paper P.

The laser exposure apparatus 26 is provided with a semiconductor laser 27 as a light source; a scan optical system (not illustrated) for scanning and exposing a laser beam on the photosensitive drum 31; a rotational polygon mirror 28 that is formed, for example, by a regular hexahedron; and a laser driver 29 for controlling driving of the semiconductor laser 27. In the laser driver 29, the image data from the image processing unit 22 and a light amount control signal from the control unit 60 or the like are inputted so as to control lighting and output light amount of the semiconductor laser 27.

The middle transcription belt 41 is formed by a no-end belt shaped in a film that an appropriate dose of a conductive agent such as carbon black is contained in a resin, for example, polyimide or polyamide. Then, its volume resistivity is determined in the range from $10^6$ or about $10^6$ to $10^{14}$ or about $10^{14}$ Ωcm, for example, and its thickness is about 0.1 mm, for example. The middle transcription belt 41 is driven in circle by various rolls at a predetermined rate in a B direction shown in FIG. 1. As these various rolls, a driving roll 47 that is driven by a motor (not illustrated) that is excellent in a constant rate property; support rolls 48*a* and 48*b* for supporting the middle transcription belt 41; a tension roll 46 for preventing meandering of the middle transcription belt 41 while giving a certain tensile force to the middle transcription belt 41; and a backup roll 49 for supporting the middle transcription belt 41 at the secondary transcribing portion T2 are disposed.

Each of the primary transcription roll 42 and the secondary transcription roll 40 is composed of a roll member that a conductive elastic body layer and a conductive surface layer are laminated in series on a core metal made of aluminum and stainless steel or the like. Then, supplied with a primary transcription bias from a primary transcription power source (not illustrated) that is provided within the power source unit 95, the primary transcription roll 42 may transcribe a toner image that is formed on the middle transcription belt 41 by each image forming unit 30. In addition, supplied with a secondary transcription bias from a secondary transcription power source (not illustrated) that is provided within the power source unit 95, the secondary transcription roll 40 may transcribe the toner image that is retained on the middle transcription belt 41 on the paper P.

A fixing apparatus 80 is provided with a fixing roll 82 having a heat source therein and a pressurization roll 83 that is arranged by pressurizing with respect to this fixing roll 82. Then, allowing the paper P retaining an unfixed toner image to pass through the nip area between the fixing roll 82 and the pressurization roll 83, the toner image is fixed on the paper P.

In the image forming apparatus 1 according to the present exemplary embodiment having the above-described configuration, an image forming process unit 20 may carry out the image forming operation under control of the control unit 60. In other words, the image data inputted from the PC3 and the image reading apparatus 4 or the like is provided with a predetermined image process by the image processing unit 22 to be stored in the laser exposure apparatus 26. Then, for example, in the image forming unit 30Y of yellow (Y), the surface of the photosensitive drum 31 that is evenly charged by the charging roll 32 at a predetermined potential is scanned and exposed by a laser beam of which lighting is controlled on the basis of the image data from the image processing unit 22 by the laser exposure apparatus 26 and an electrostatic latent image is formed on the photosensitive drum 31. The formed electrostatic latent image is developed by the developing units 33Y, and on the photosensitive drum 31, a toner image of yellow (Y) is formed on the photosensitive drum 31. Also in image forming units 30M, 30C, and 30K, respective color toner images of magenta (M), cyan (C), and black (K) are formed in the same way.

Respective toner images formed by respective image forming units 30 are electrostatically transcribed in series by the primary transcription roll 42 to which a predetermined primary transcription bias is applied from a transcription power source (not illustrated) on the middle transcription belt 41 moving in a circle in an arrow B direction of FIG. 1, and then, a toner image superimposed on the middle transcription belt 41 is formed. This superimposed toner image is conveyed toward the secondary transcribing portion T2 on which the secondary transcription roll 40 and the backup roll 49 are arranged in accordance with movement of the middle transcription belt 41.

On the other hand, the paper P is removed from a paper retaining unit 71 by a pickup roll 72 for discharge of the paper P to be conveyed up to the position of a resist roll 74 for regulating the position of the paper along a conveying path R1. Then, the paper P is conveyed from the resist roll 74 toward the secondary transcribing portion T2 in synchronization with a timing that the superimposed toner image is conveyed toward the secondary transcribing portion T2. In this case, the paper P may pass through a nip area between the pre-transcription charging roll 100 and the pre-transcription heating roll 150 on a conveying path between the resist roll 74 and the secondary transcribing portion T2. Then, as described later, the surface of the side of the secondary transcription of the paper P is charged at a predetermined potential by the pre-transcription charging roll 100. Therewith, being heated by the pre-transcription heating roll 150, water content in the paper P is evaporated and the paper P is controlled to have a resistance value in a predetermined range.

Further, the paper P is conveyed to the resist roll 74 also from a double-faced conveying path R2 and a conveying path R3 from a paper retaining portion for manual paper feed 75.

After passing through the nip area between the pre-transcription charging roll 100 and the pre-transcription heating roll 150, in the secondary transcribing portion T2, the superimposed toner image is electrostatically transcribed (secondarily transcribed) on the paper P in block due to an effect of a transcription electric field that is formed between the secondary transcription roll 40 to which the secondary transcription bias is applied and the backup roll 49.

When the superimposed toner image is electrostatically transcribed on the paper P, the paper P is separated from the middle transcription belt 41 to be conveyed to a fixing apparatus 80. An unfixed toner image on the paper P that is conveyed to the fixing apparatus 80 is fixed on the paper P being provided with fixing processing due to heat and a pressure by means of the fixing apparatus 80. Then, the paper P on which a fixed image is formed is conveyed to a paper loading unit 91 that is disposed on a discharge unit of the image forming apparatus 1. On the other hand, the toner attached to the middle transcription belt 41 after the secondary transcription is removed by a belt cleaner 45 contacting the middle transcription belt 41 to be prepared for a next image formation cycle.

In this way, image formation by the image forming apparatus 1 is carried out repeated in the number of times equivalent to the designated number of copies.

Consequently, the pre-transcription charging roll 100 and the pre-transcription heating roll 150, which are arranged contacting by pressurizing each other in the conveying path between the resist roll 74 and the secondary transcribing portion T2 will be described in detail.

Figure 2:
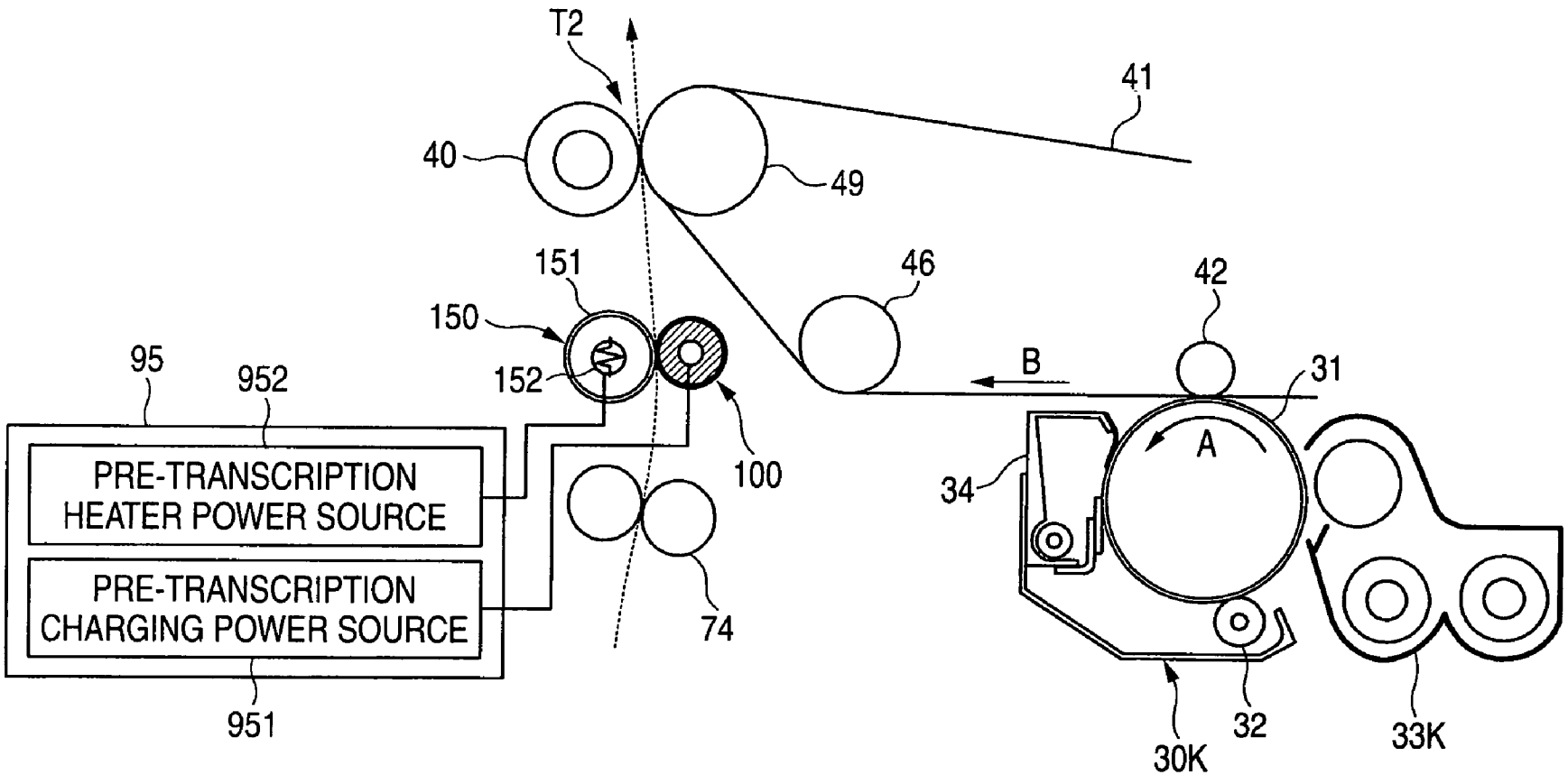
FIG. 2 is a view explaining the constitution of an area between a resist roll and a secondary transcribing portion T2.

FIG. 2 is a view explaining the constitution of an area between the resist roll 74 and the secondary transcribing portion T2. As shown in FIG. 2, the pre-transcription charging roll 100 and the pre-transcription heating roll 150 are arranged at the downstream side in a conveying direction of the paper P of the resist roll 74 and on the position on the conveying path of the paper P upward from the secondary transcribing portion T2. In addition, the pre-transcription charging roll 100 is arranged at the side (the face contacting the middle transcription belt 41 at the secondary transcribing portion T2) of the secondary transcription face of the paper P, and the pre-transcription heating roll 150 is arranged at the side (the face-contacting the secondary transcription roll 40 at the secondary transcribing portion T2) of its rear face. Then, the paper P conveyed from the resist roll 74 is configured so that the transcription processing is carried out at the secondary transcribing portion T2 after passing through the nip area between the pre-transcription charging roll 100 and the pre-transcription heating roll 150.

Figure 3:
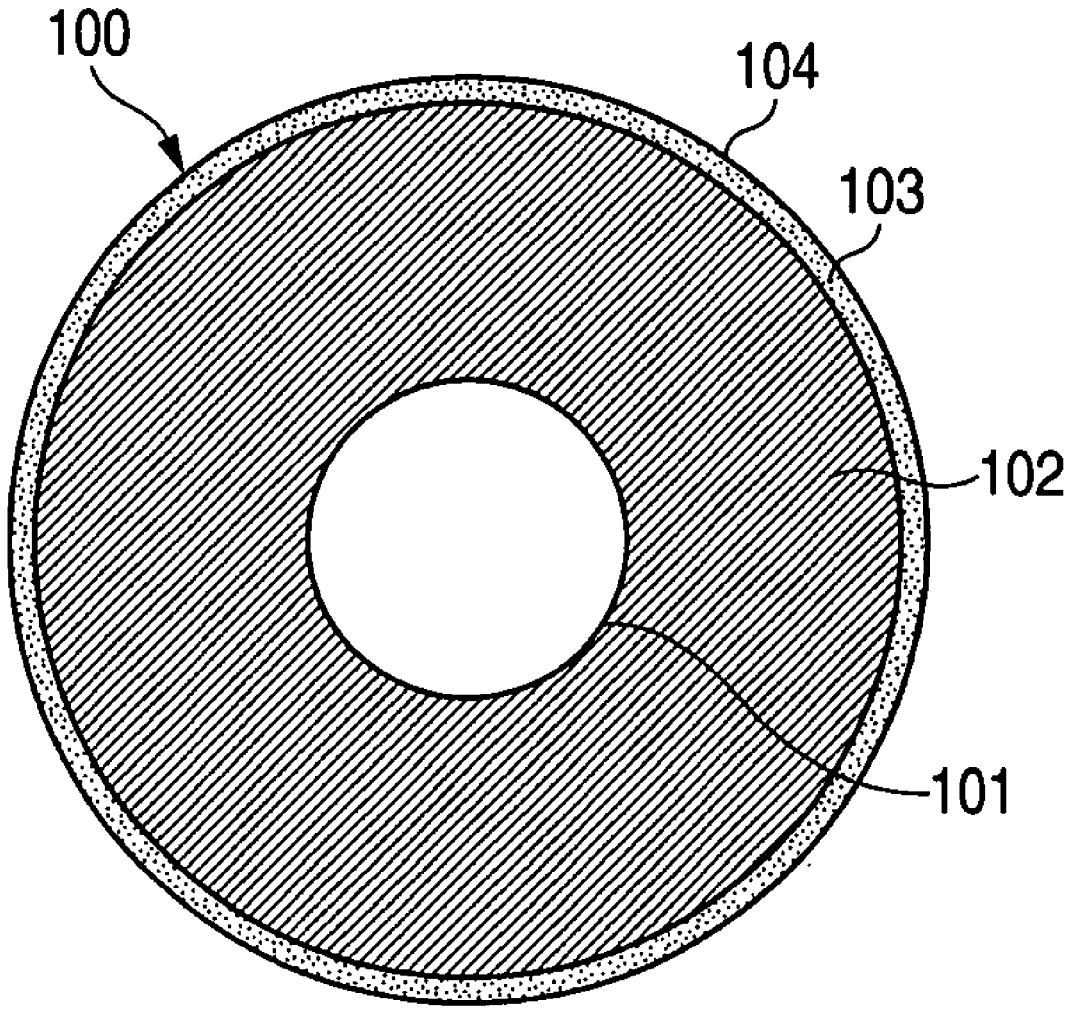
FIG. 3 is a view explaining a configuration of a cross section of the pre-transcription charging roll.

As shown in FIG. 3 (a view explaining a configuration of a cross section of the pre-transcription charging roll 100), the pre-transcription charging roll 100 is configured in such a manner that on a conductive shaft 101, namely, a roll member having an outer diameter of 14 mm, for example, made of aluminum and a stainless steel or the like, a first layer 102, for example, made of a polyurethane rubber foam that an appropriate dose of a conductive agent such as carbon black is contained; a second layer 103 having a thickness of 500 μm that is made of a chloroprene rubber that an appropriate dose of a conductive agent such as carbon black coating the surface of the first layer 102 is contained; and a third layer 104 having a film thickness of 10 μm made of a polytetrafluoroethylene (PTFE) distributed polyurethane emulsion spray-coating the surface of the second layer 103 are laminated. Then, the pre-transcription charging roll 100 is configured so as to have a volume resistivity about $10^7$ Ωcm (when 100V is applied) and an elastic hardness about 30° (ASKER C: SRIS 0101).

In addition, the pre-transcription charging roll 100 is provided with a bias of a polarity opposed to a toner polarity from a pre-transcription charging power source 951 as an example of a voltage supplying section that is disposed in the power source unit 95. Thereby, the pre-transcription charging roll 100 may charge the secondary transcription face of the paper P at a predetermined potential of a polarity opposed to a toner polarity.

The pre-transcription heating roll 150 is a roll member having an outer diameter of 20 mm that a pipe roll 151 made of, for example, aluminum and a stainless steel is coated with a silicone rubber layer having a thickness of 0.5 μm on which surface fluorine contained resin is evenly applied. Then, the volume resistivity of the pre-transcription heating roll 150 is determined to be about $10^{6.5}$Ω (when 100V is applied). In addition, a halogen heater of a rated power 600 W is deployed within the pipe roll 151 and a predetermined power is supplied to the halogen heater 152 from a pre-transcription heater power source 952 disposed within the power source unit 95. Thereby, the pre-transcription heating roll 150 may heat the paper P from its rear face side.

Further, the pipe roll 151 is earthed and the pre-transcription heating roll 150 may also function as an opposed electrode of the pre-transcription charging roll 100.

In addition, the pre-transcription charging roll 100 is rotatably driven at an equal rate as the resist roll 74 by a driving motor (not illustrated) and the pre-transcription heating roll 150 is configured so as to dependently rotate for the pre-transcription charging roll 100.

Further, a bias supplied from the pre-transcription charging power source 951 to the pre-transcription charging roll 100 and a power supplied from the pre-transcription heater power source 952 to the halogen heater 152 can be adjusted, respectively, under the control of the control unit 60 (refer to FIG. 1). Thereby, determination of the charging amount to be supplied from the pre-transcription charging roll 100 and the surface temperature of the pre-transcription heating roll 150 can be changed, respectively (further, refer to the third exemplary embodiment).

In the image forming apparatus 1 according to the present exemplary embodiment, disposing the above-described pre-transcription charging roll 100 and pre-transcription heating roll 150 on the conveying path between the resist roll 74 and the secondary transcribing portion T2, charging and heating are carried out at the same time for the paper P just before proceeding into the secondary transcribing portion T2. Thereby, even in the case that, for example, the paper P having concavity and convexity on its surface is used, a transcription rate of the superimposed image at the secondary transcribing portion T2 is determined so as to be even on the entire face of the paper P.

In recent years, as a recording medium used for the image forming apparatus, various kinds of papers are used. Among them, a paper imaging a leathery pattern having premium accents and a Japanese-paper flavor or the like are also sold as a recording material. For example, LETHAC 66 (a trade name) manufactured by Tokush Paper Kabushiki Kaisha is a representative thereof.

However, a special paper such as LETHAC 66 has concavo-convex patterns on its surface by an embossing finish or the like in order to have premium accents. Therefore, according to the related-art image forming apparatus, it is difficult to transcribe a toner image sufficiently till such a concave portion and this involves an inconvenience such that unevenness of density is easily formed on the image. In other words, in the concave portion of the paper P having concavo-convex patterns thereon, a transcription electric field becomes very weak at the secondary transcribing portion T2 in the concave portion of the paper P having concavo-convex patterns thereon, so that a transcription rate of a toner from the middle transcription belt 41 is decreased. Such a degree of lowering of the transcription rate of the toner may be different depending on a particle diameter and a charging amount of the toner and a material of the middle transcription belt 41 as an image retaining body or the like, however, mainly, it is different depending on a size and a depth of the concave portion. If the depth of the concave portion is about 5 to 10 μm, for example, an influence on a quality of an image due to lowering of the transcription-rate is not so large, however, if the depth of the concave portion is about 80 μm, for example, like LETHAC 66, deterioration of a quality of an image due to defect of transcription cannot be ignored. In addition, according to the image forming apparatus 1 of a so-called tandem type using the middle transcription belt 41, the toner image has a large charging amount due to the primary transcription on each image forming unit 30, so that an adherence with the middle transcription belt 41 is strong and therefore, this image forming apparatus 1 has a tendency to make lowering of the transcription rate in the concave portion larger.

Thus, in the case of using the paper P having concavo-convex patterns thereon, a low density portion (unevenness of density) along the concave portion due to lowering of the transcription rate in the concave portion is generated, and as a result, a quality of an image may be decreased.

Therefore, the image forming apparatus 1 according to the present invention is configured in such a manner that the paper P just before proceeding into the secondary transcribing portion T2 is charged by the pre-transcription charging roll 100 so that a toner image can be sufficiently transcribed up to the concave portion of the paper P, on which surface concavo-convex patterns are formed.

As described above, the pre-transcription charging roll 100 according to the present invention is soft and its elastic hardness is about 30° (ASKER C: SRIS 0101). Therefore, the surface of the pre-transcription charging roll 100 is easily deformed in accordance with the concavo-convex patterns of the paper P, so that a charging amount can be put in the interior part of the concave portion. Thereby, the pre-transcription charging roll 100 may supply a sufficient charging amount up to the interior part of the concave portion by putting a discharge distance from the surface of the pre-transcription charging roll 100 closer.

Normally, the embossing finishing for the paper is completed by allowing the paper to pass, for example, between a rubber roll and a metal roll having the concavo-convex patterns thereon and embossing the paper. The depth of concavity and convexity is decided by a type of a metal roll. There are various depths and, for example, the above-described LETHAC 66 has the depth in the range of several μm to 80 μm. Here, in FIGS. 4A and 4B, a general modification shape of the pre-transcription charging roll 100 in the case of using the pre-transcription charging rolls 100 having different harnesses is shown.

Figure 4A:
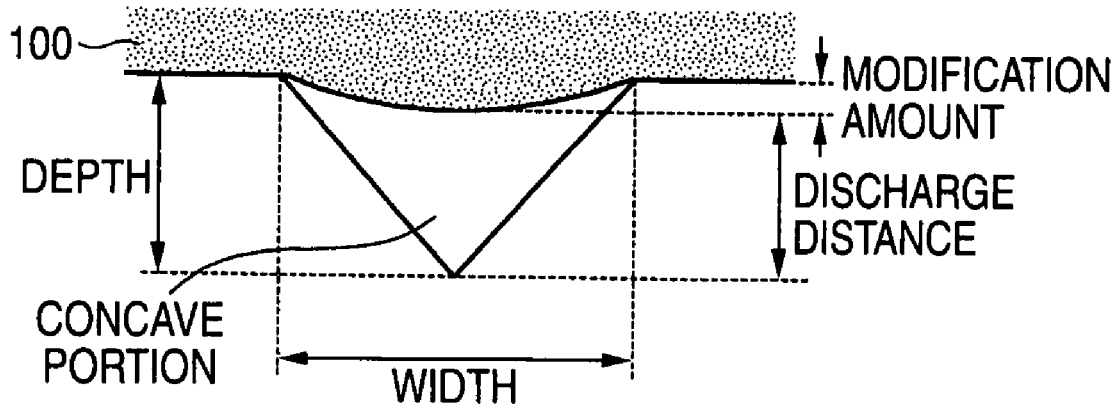
FIGS. 4A and 4B are views showing a general modification formation of the pre-transcription charging roll when the pre-transcription charging roll having a different hardness is used.
Figure 4B:
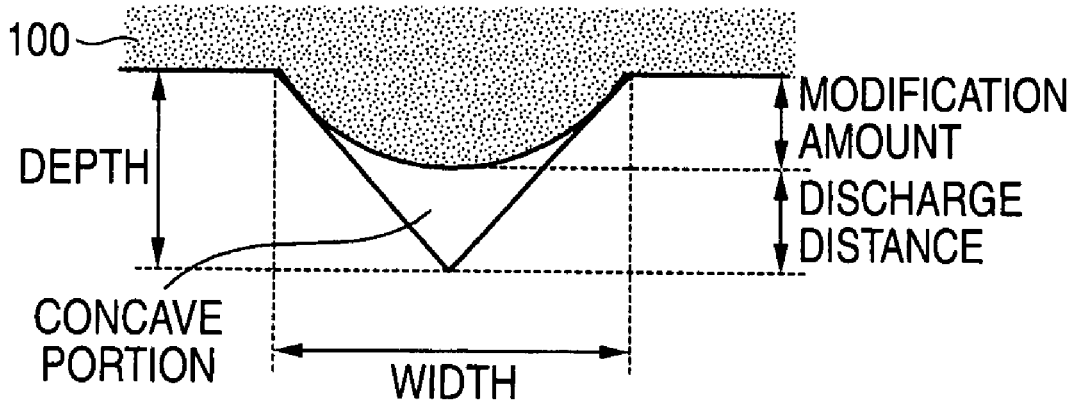

As shown in FIG. 4A, in the case that the hardness of the pre-transcription charging roll 100 is high (for example, the hardness is about not less than 35°), a discharge distance becomes longer because the change amount of the pre-transcription charging roll 100 on the concave portion of the paper is small. As a result, it is not possible to efficiently give an electric charge in the concave portion. On the other hand, as shown in FIG. 4B, in the case that the hardness of the pre-transcription charging roll 100 is lower (for example, the hardness is not more than 30°), the discharge distance becomes shorter because the modification amount of the pre-transcription charging roll 100 in the concave portion of the paper is larger. As a result, the electric charge is given up to the interior part of the concave portion.

Thus, since the pre-transcription charging roll 100 according to the present exemplary embodiment has a soft elastic hardness about 30° (ASKER C: SRIS 0101), the modification amount is increased in accordance with the depth of the concave portion, so that the discharge distance is made closer depending on the depth of the concave portion. Therefore, the pre-transcription charging roll 100 may supply a sufficient charging amount up to the interior part of the concave portion in spite of the depth of the concave portion. Thereby, a toner sucking force due to the charged electric charge supplied from the pre-transcription charging roll 100 and an effect of the transcription electric field in the secondary transcribing portion T2 are multiplied so as to improve the transcription rate of the toner to the concave portion.

Further, in the case of using the roll member having an elastic hardness more than 30° or about 30° (ASKER C: SRIS 0101), for example, not less than 35° or about 35° (ASKER C: SRIS 0101), the above-described effect so as to shorten the discharge distance is hardly realized, so that the charged electric charge to realize a transcription rate 85% or about 85% in the concave portion shown in a rear stage of FIG. 6 cannot be given.

From the above-described view point, as the pre-transcription charging section, it is preferable that a contact charging section as a pre-transcription charging roll 100 is used. For example, according to a charging section for carrying out charging due to discharge like a corotoron-type and a scorotron-type, for example, an electric charge charging a peripheral part of the concave portion and an entrance portion of the concave portion prevents the sufficient charging amount from being supplied up to the interior part of the concave portion and it is difficult to supply the sufficient charging amount.

In addition, the pre-transcription charging roll 100 may supply the sufficient charging amount up to the interior part of the concave portion due to the above-described mechanism if its elastic hardness is not more than 30° (ASKER C: SRIS 0101), however, it is preferable that the elastic hardness is not less than 15° (ASKER C: SRIS 0101) from a view point of manufacture.

In addition, the image forming apparatus 1 according to the present invention is configured so that the resistance value of the paper P is determined to be within a predetermine range by heating the paper P by means of the pre-transcription heating roll 150 to evaporate water content of the paper P while being charged by the pre-transcription charging roll 100 at the same time.

For example, in a moist season like a Japanese rainy season or the like, a rate of water content of the paper P may be increased up to about 6% being retained in the paper retaining unit 71. If a user uses such a moist paper P as it is, the pre-transcription charging roll 100 cannot sufficiently charge the paper P in many cases. In such a case, even if the pre-transcription charging roll 100 charges the paper P, in the secondary transcribing portion T2, the charging amount whereby the toner image is sufficiently charged up to the concave portion of the paper P cannot be retained in the concave portion.

Therefore, the image forming apparatus 1 according to the present invention may carry out charging of the paper P by means of the pre-transcription charging roll 100 and heating by means of the pre-transcription heating roll 150 at the same time. Further, the image forming apparatus 1 according to the present invention may be configured so as to heat the paper P by means of the pre-transcription heating roll 150 before charging by means of the pre-transcription charging roll 100 arranging the pre-transcription heating roll 150 at the upstream side from the pre-transcription charging roll 100 and at the downstream side from the resist roll 74.

Successively, the arrangement position between the pre-transcription charging roll 100 and the pre-transcription heating roll 150 relating to the secondary transcribing portion T2 will be described.

In consideration of the fact that attenuation of an electric charge retained on the paper is fast, according to the information forming apparatus 1 of the present invention, the pre-transcription charging roll 100 and the pre-transcription heating roll 150 are arranged on the conveying path between the resist roll 74 and the secondary transcribing portion T2. Thereby, the configuration such that the paper P can attain to the secondary transcribing portion T2 before attenuation of the electric charge on the paper P that is charged by the pre-transcription charging roll 100 is realized.

Figure 5:
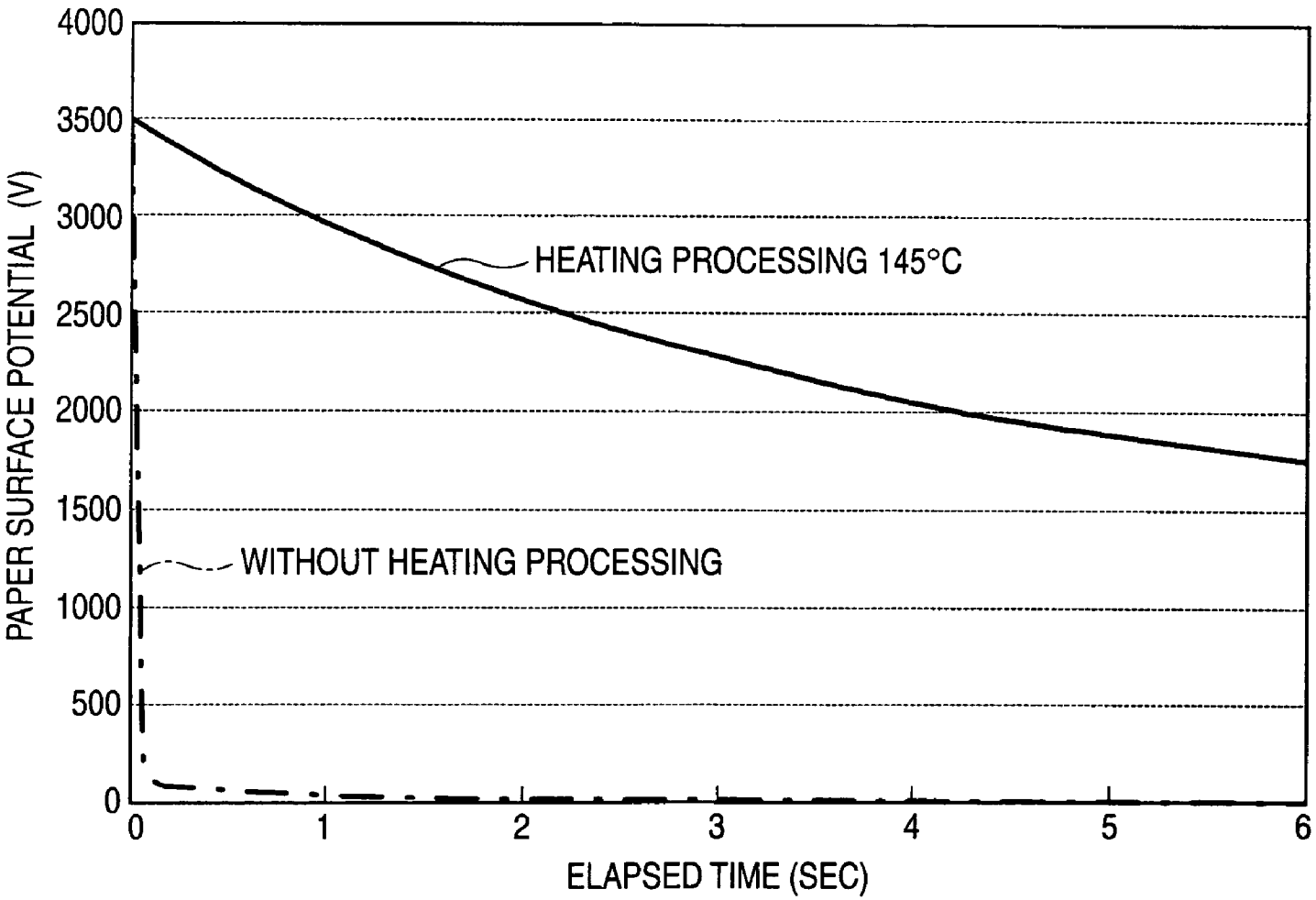
FIG. 5 is a view showing a time shift of a surface potential of the paper P (a potential of the surface of the paper) that is charged by the pre-transcription charging roll.

At first, FIG. 5 is a view showing a time shift of a surface potential of the paper P (a potential of the surface of the paper) that is charged by the pre-transcription charging roll 100. In FIG. 5, in the case of charging the paper P by means of the pre-transcription charging roll 100 to 3,500 V, the time shifts of the surface potential of the paper P when the paper P is heated by means of the pre-transcription heating roll 150 of which surface temperature is determined to be 145° C. and when the paper P is not heated are shown. In addition, the used paper P is a paper of LETHAC 66 and its weight is 151 g/m$^2$ and its original water content is 6%. Further, the surface potential of the paper P is obtained by a method for measuring the surface potential of the paper P closing the paper P to the earthed metal plate.

As shown in FIG. 5, the voltage of the paper P that is not heated is attenuated from 3,500 V to about 0 V for several msec. In addition, the attenuation rate of the paper P that is heated at 145° C. is dramatically lower than that of the paper P that is not heated, however, the attenuation of the voltage is generated in increments of a second. Since the secondary transcribing portion T2 of the image forming apparatus 1 is closed to the fixing apparatus 80, in consideration of the fact that a degree of humidity is relatively high due to a moisture vapor when the fixing apparatus 80 heats the paper P and further, the concavo-convex patterns are formed on the surface like LETHAC 66 has a large surface area and this makes it easy to such a humidity for a short time, as a result of FIG. 5, in order to control the paper P to retain a sufficient charging amount in the secondary transcribing portion T2, it is a condition to charge the paper P by means of the pre-transcription charging roll 100 before 1 to 2 seconds of approach of the paper P into the secondary transcribing portion T2 in order to control the paper P to retain the sufficient charging amount in the secondary transcribing portion T2.

Figure 6:
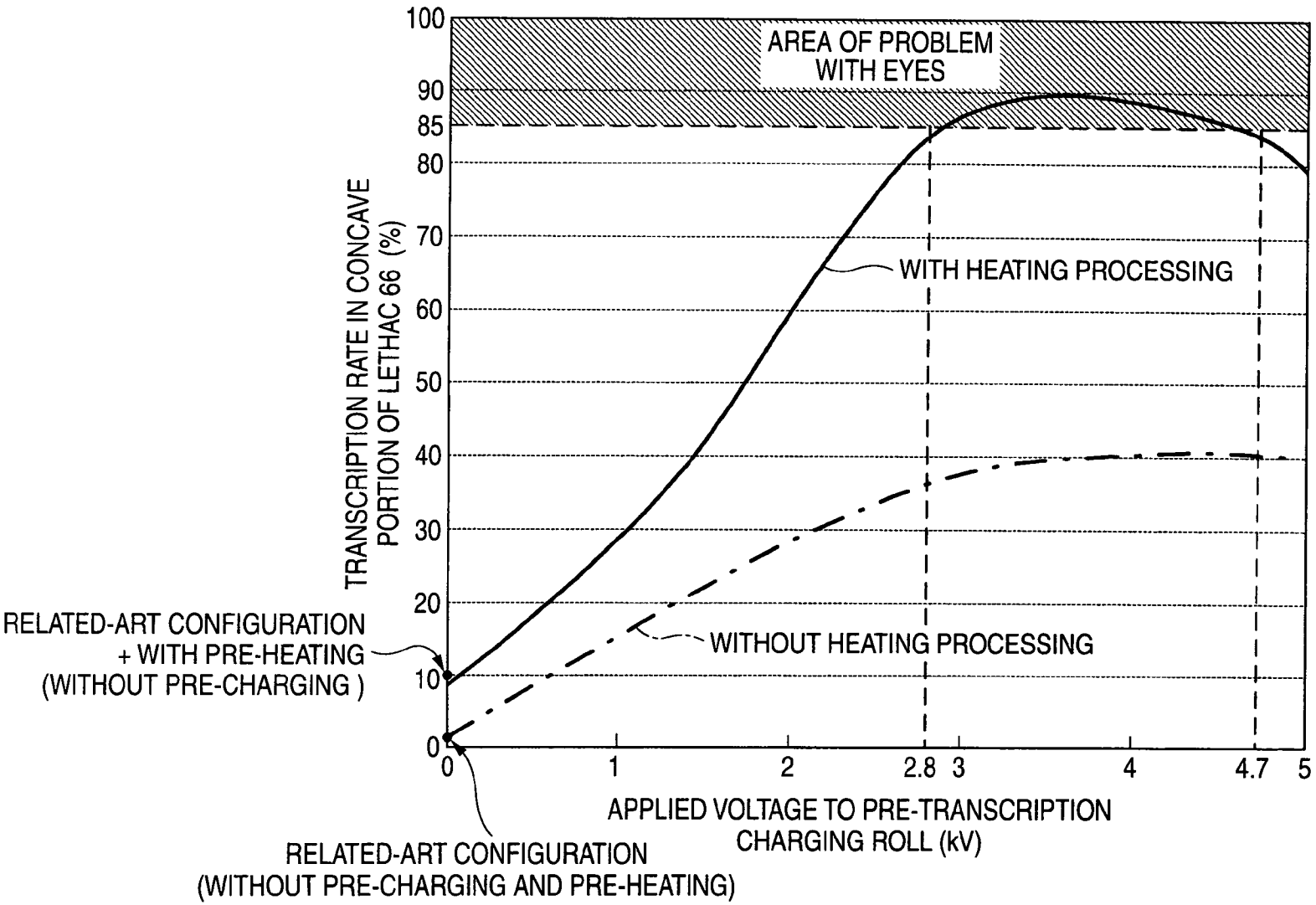
FIG. 6 is a view a view showing a relation between an applied voltage to the pre-transcription charging roll and a transcription rate in the concave portion of the paper P.

Next, FIG. 6 is a view showing a relation between an applied voltage to the pre-transcription charging roll 100 when using a paper of LETHAC 66 and its weight is 151 g/m$^2$ and its original water content is 6% as the paper P and a transcription rate in the concave portion of the paper P. In FIG. 6, the case that the paper P is heated by the pre-transcription heating roll 150 of which surface temperature is determined to be 145° C. and the case that the paper P is not heated are shown. In addition, the transcription rate is a value representing a density of the image in the concave portion when the toner image is transcribed and fixed with respect to the image density on the paper P when the toner images retained on the middle transcription belt 41 are entirely transcribed on the paper P to be fixed thereon by a percentage.

It is known that a difference between the image density in the concave portion of the paper P and the image density in a peripheral part thereof is not so visible by eyes and the transcription rate of the concave portion that is at a level of no problem is in the range of not less than 85% according to an empirical rule. In order to realize the transcription rate of 85% in the concave portion in the image forming apparatus 1 according to the present exemplary embodiment, as being known from FIG. 6, it is a condition to determine an applied voltage to the pre-transcription charging roll 100 to be 2,800 V to 4,700 V. In this case, it is necessary to determine the resistance value of the paper P to be within a predetermined range by carrying out heating operation of the paper by means of the pre-transcription heating roll 150. Further, as being known from FIG. 6, when the heating operation by means of the pre-transcription heating roll 150 is not applied to the paper P, the transcription rate 85% in the concave portion cannot be realized.

Therefore, according to the image forming apparatus 1 of the present exemplary embodiment, on the basis of a potential attenuation property of the page P heated to 145° C. that is obtained in FIG. 5 and a condition such that a lower limit potential for realizing the transcription rate 85% in the concave portion obtained in FIG. 6 is not less than 2,800V, the arrangement relation between the pre-transcription charging roll 100 and the pre-transcription heating roll 150 relating to the position of the secondary transcribing portion T2 is determined.

Thus, according to the image forming apparatus 1 of the present exemplary embodiment, even if the attenuation of the potential is generated on the paper P, the pre-transcription charging roll 100 is arranged closed to the secondary transcribing portion T2 so that a lower limit value forming a sufficient transfer electric field for transferring a toner image in the concave portion of the paper P is maintained in the secondary transcribing portion T2. Then, in this case, a practical arrangement position such that the pre-transcription charging roll 100 can be arranged closed to the secondary transcribing portion T2 is realized by heating the paper P by means of the pre-transcription heating roll 150 and adjusting the resistance value of the paper P.

In addition, in such a configuration of the image forming apparatus 1 of the present exemplary embodiment, after charging the paper P by means of the pre-transcription charging roll 100 and heating the paper P by means of the pre-transcription heating roll 150 are carried out, if other member contacts the paper P, an electric charge given to the paper P is discharged from that member and heat is absorbed. Therefore, the configuration that no member is arranged among the secondary transcribing portion T2, the pre-transcription charging roll 100, and the pre-transcription heating roll 150 is preferable.

Therefore, in such a configuration of the image forming apparatus 1 of the present exemplary embodiment, being arranged closed to the secondary transcribing portion T2, the pre-transcription charging roll 100 and the pre-transcription heating roll 150 are arranged at the downstream side of the resist roll 74 for conveying the paper P toward the secondary transcribing portion T2 in synchronization with timing that the superimposed toner image on the middle transcription belt 41 is conveyed to the secondary transcribing portion T2.

In this case, in order to prevent a transcription misalignment from being generated when unevenness is generated in the conveying rate of the paper P on the secondary transcribing portion T2 due to the influences of the pre-transcription charging roll 100 and the pre-transcription heating roll 150 that are arranged between the secondary transcribing portion T2 and the resist roll 74, a frictional force among the pre-transcription charging roll 100, the pre-transcription heating roll 150, and the paper P becomes smaller than a frictional force between the middle transcription belt 41 and the paper P. Specifically, a surface material and a surface roughness or the like of the pre-transcription charging roll 100 and the pre-transcription heating roll 150 are determined so that a relation that $\mu_1<\mu_2<\mu_3$ is established between a static friction coefficient $\mu_1$ between the pre-transcription charging roll 100 and the secondary transcription face of the paper P, a static friction coefficient $\mu_2$ between the pre-transcription heating roll 150 and the rear face of the paper P (the secondary transcription face and the opposite side face), and a static friction coefficient $\mu_3$ between the middle transcription belt 41 and the secondary transcription face of the paper P, respectively. For example, these static friction coefficients are adjusted as follows; namely, $\mu_1=0.35$, $\mu_2=0.48$, and $\mu_3=0.62$, respectively.

Thereby, even if the conveying force of the paper P in the secondary transcribing portion T2 is made larger than the conveying forces in the pre-transcription charging roll 100 and the pre-transcription heating roll 150 and a force so as to generate an unevenness in the conveying rate of the paper P by means of the pre-transcription charging roll 100 and the pre-transcription heating roll 150 is effected, the image forming apparatus 1 of the present exemplary embodiment is determined so that its effect is realized in the transcription image due to the conveying force of the paper P in the secondary transcribing portion T2.

Here, a measurement method of a static friction coefficient will be described. As a measurer, HEIDON Tribogear μs Type 94i is used. Then, in the case of measuring two members, fixing one of them to a probe of the measurer and fixing other one on a plate that is disposed on the position opposed to other one, these two members are measured under a predetermined pressurization. For example, in the case of measuring the static friction coefficient $\mu_1$ between the pre-transcription charging roll 100 and the secondary transcription face of the paper P, at first, the paper P is cut so as to be the same size as a probe made of a metal plate with a diameter about 30 mm to be pasted to the probe. In addition, fixing the pre-transcription charging roll 100 on the position opposed to the probe by a jig so as to allow the pre-transcription charging roll 100 to contact the probe. In this case, the probe and the pre-transcription charging roll 100 are vertically superimposed and fixed so that the probe is located upward and the pre-transcription charging roll 100 is located downward. Then, moving the probe in a horizontal direction, the static friction coefficient $\mu_1$ is measured. Further, a vertical drag (an empty weight) and a force to be added for moving the probe in parallel are determined at a predetermined value by the measurer.

Next, according to the image forming apparatus 1 of the present exemplary embodiment, by using a paper of LETHAC 66 of 151 g/m$^2$, a paper of LETHAC 66 of 203 g/m$^2$, and a paper of LETHAC 66 of 250 g/m$^2$ that are adjusted into a water content of 6% under environment that a temperature is 28° C. and a relative humidity is 86% and those paper that are adjusted into a water content of 4% under environment that a temperature is 28° C. and a relative humidity is 75%, it is checked if a defect of an image is generated or not from a viewpoint of a transference defect in the concave portion. This result is shown in FIG. 7. In FIG. 7, a process speed of the image forming apparatus 1 is defined as 52 mm/sec, and the pre-transcription charging roll 100 and the pre-transcription heating roll 150 are arranged at the upstream side position from the secondary transcribing portion T2 by 55 mm. In addition, 3,500V is applied to the pre-transcription charging roll 100 and the pre-transcription heating roll 150 is determined to be not heated, be heated at 125° C., and be heated at 145° C. In addition, as the elastic hardness of the pre-transcription charging roll 100, 30° (ASKER C: SRIS 0101) is used.

As shown in FIG. 7, in the case of not heating, except the case that the paper of LETHAC 66 of 151 g/m$^2$ is determined to have a water content of 4%, a defect of an image of a level such that the all transcription defects in the concave portion cannot be ignored is generated. In addition, in the state of heating the pre-transcription heating roll 150 at 125° C., when a paper of LETHAC 66 of 203 g/m$^2$ is determined to have water content 6% and in the paper of the paper of LETHAC 66 of 250 g/m$^2$, the same defect of the image is generated. This may be attributed to the fact that water content in these papers P cannot be sufficiently evaporated according to a heating process at 125° C. by means of the pre-transcription heating roll 150 and in the secondary transcribing portion T2, the resistance value of the paper P so as to maintain the sufficient electric charge for transcribing the toner image on the concave portion of the paper P cannot be realized.

On the contrary, in the state of heating the pre-transcription heating roll 150 at 145° C., with respect to the all papers P used for a test, an excellent quality of an image that the transcription defect in the concave portion is not visible is obtained.

Accordingly, it is preferable to adopt setting for heating the pre-transcription heating roll 150 not less than 145° C.

However, as shown in FIG. 3, the pre-transcription charging roll 100 according to the present exemplary embodiment is configured so that the third layer 104 made of a polytetrafluoroethylene (PTFE) distributed polyurethane emulsion is arranged as a surface layer. For example, the pre-transcription charging roll 100 according to the present exemplary embodiment may be configured by a roll member of an electric charge injection type as a contact charging section having a fur and a brush of which liner diameter is determined so as to be able to progress into the concave portion of the paper P formed on its surface.

In addition, the pre-transcription charging roll 100 also may be configured so as to be able to take shelter to the position separated from the conveying path by means of a moving mechanism (not illustrated) in the case that a paper having no concavo-convex patterns, for example, a regular paper is used as the paper P.

Further, providing a resistance measuring section for measuring a resistance value of the paper P at the upstream side in the conveying direction of the paper P of the pre-transcription charging roll 100 and the pre-transcription heating roll 150, when the resistance value of the paper P is measured to be not more than a predetermined value, it is possible to control the image forming apparatus 1 so as to carry out the charging processing by means of the pre-transcription charging roll 100 and carry out heating processing by means of the pre-transcription heating roll 150. In this case, as the resistance measuring section, for example, a system for applying a predetermined voltage to a pair of conductive roll members and measuring the resistance value of the paper P due to a current value passing through this roll member can be used.

In addition, providing a surface roughness measuring section for measuring a surface roughness of the paper P at the upstream side in the conveying direction of the paper P of the pre-transcription charging roll 100 and the pre-transcription heating roll 150, when the surface roughness of the paper P is measured to be not less than a predetermined value, it is possible to control the image forming apparatus 1 so as to carry out the charging processing by means of the pre-transcription charging roll 100 and carry out heating processing by means of the pre-transcription heating roll 150. In this case, as the surface roughness measuring section, a system including, for example, a light emission portion for irradiating a light to the paper P and a light receiving portion for measuring its reflection light for measuring the surface roughness of the paper P due to a light amount to be measured by a light receiving portion can be used.

As described above, according to the image forming apparatus 1 of the present exemplary embodiment, it is possible to realize the configuration maintaining a charging amount that can transcribe a toner image sufficiently up to the concave portion of the paper P in the secondary transcribing portion T2 by carrying out the charging processing by means of the pre-transcription charging roll 100 and the heating processing by means of the pre-transcription heating roll 150 for the paper P at the same time in the conveying path between the resist roll 74 and the secondary transcribing portion T2.

Thereby, the toner image can be sufficiently transcribed up to the concave portion of the paper P having concavity and convexity and it is possible to provide an excellent image with little unevenness.

Second Exemplary Embodiment

According to the first exemplary embodiment, the configuration for fixing and arranging the pre-transcription charging roll 100 and the pre-transcription heating roll 150 in the conveying path between the resist roll 74 and the secondary transcribing portion T2 is described. According to the second exemplary embodiment, the configuration that the pre-transcription charging roll 100 and the pre-transcription heating roll 150 are moving along the conveying path will be described. Further, the same configurations as the first exemplary embodiment are given the same reference numerals and marks and their detailed explanations are herein omitted.

Figure 8:
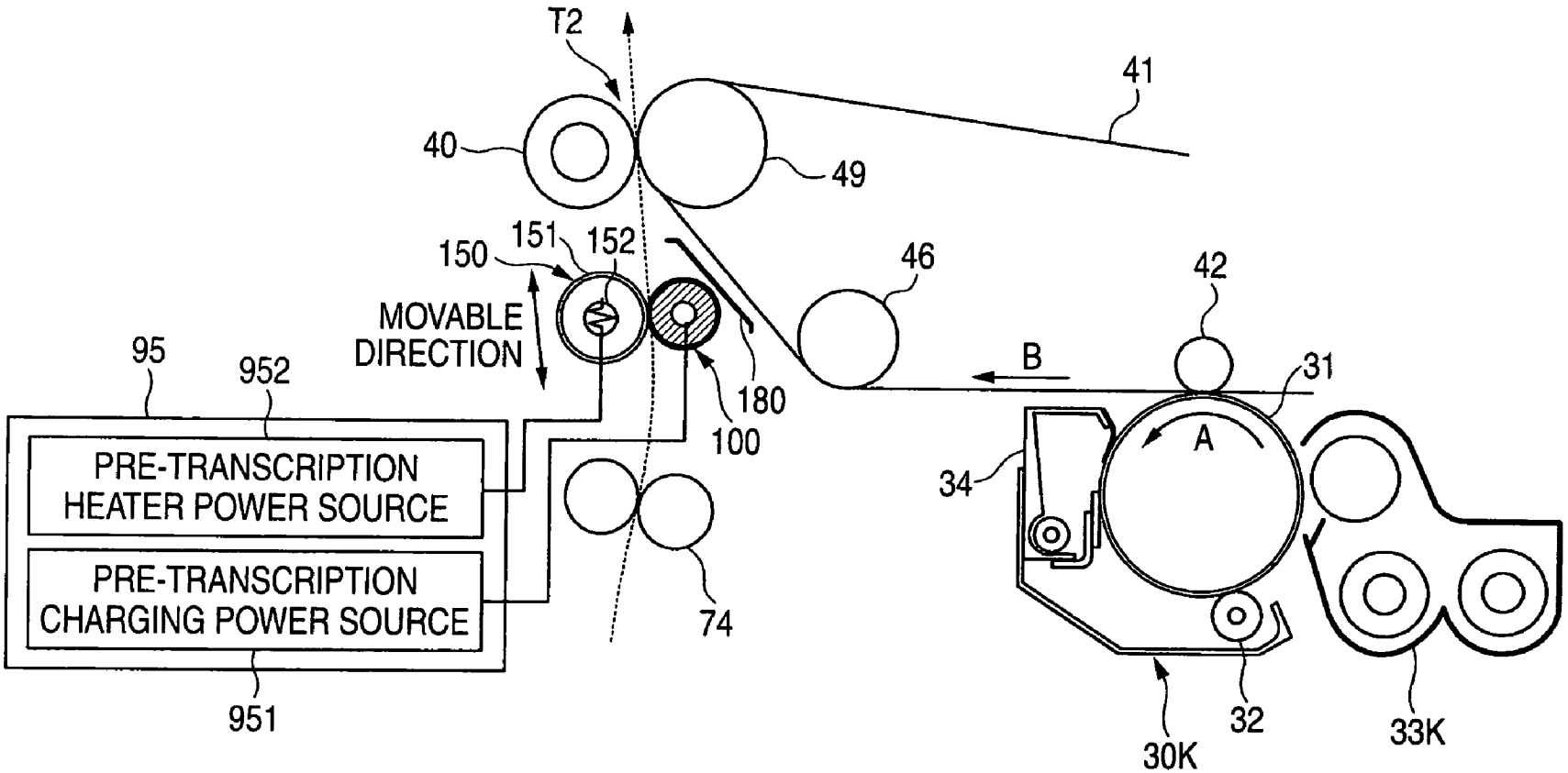
FIG. 8 is a view explaining a configuration of an area between a resist roll and a secondary transcribing portion T2.

FIG. 8 is a view explaining a configuration of an area between the resist roll 74 and the secondary transcribing portion T2 in the image forming apparatus 1 according to the present exemplary embodiment. As shown in FIG. 8, the pre-transcription charging roll 100 and the pre-transcription heating roll 150 are configured so as to be able to move in a direction of the side of the resist roll 74 or in a direction of the side of the secondary transcribing portion T2 along the conveying path of the paper P between the resist roll 74 and the secondary transcribing portion T2 by the moving mechanism (not illustrated).

Then, according to the image forming apparatus 1 according to the present exemplary embodiment, for example, under an environment that a relative humidity is high or in the case of using a thick paper P that is difficult to evaporate water content sufficiently, the pre-transcription charging roll 100 and the pre-transcription heating roll 150 are moved along the conveying path of the paper P in a direction of the side of the secondary transcribing portion T2. Thereby, by moving the pre-transcription charging roll 100 and the pre-transcription heating roll 150 at the position where the attenuation of the potential of the paper P is decreased as shown in FIG. 5, it is unnecessary to increase a bias to be supplied from the pre-transcription charging power source 951 to the pre-transcription charging roll 100 or it is possible to use an economical and portable pre-transcription charging power source 951.

In addition, according to the image forming apparatus 1 according to the present exemplary embodiment, in the vicinity of the side facing to the side of the pre-transcription charging roll 100 of the middle transcription belt 41, a shielding member 180 for electrically shielding the middle transcription belt 41 and the pre-transcription charging roll 100 is arranged. The shielding member 180 is made of a conductive metal plate or the like, for example, and a bias having the same polarity as the polarity of the toner retained in the middle transcription belt 41 is supplied from the power source unit 95 or is earthed.

Thereby, in the case that the pre-transcription charging roll 100 moves in a direction of the side of the secondary transcribing portion T2 along the conveying path of the paper P, the shielding member 180 prevents the toner retained in the middle transcription belt 41 from being transferred to the pre-transcription charging roll 100 provided with a bias of an opposite polarity of the toner polarity.

Therefore, in the case that the pre-transcription charging roll 100 is moved in a direction of the side of the secondary transcribing portion T2 along the conveying path of the paper P, it is prevented that the toner transferred to the pre-transcription charging roll 100 spoils the secondary transfer face of the paper P and the defect of the image is generated.

Here, FIG. 9 is a view comparing a quality of an image depending on dispersal to the pre-transcription charging roll 100 of the toner in the case of changing a distance between the middle transcription belt 41 and the pre-transcription charging roll 100 when the pre-transcription charging roll 100 is moved in a direction of the side of the secondary transcribing portion T2 along the conveying path of the paper P. In FIG. 9, a process speed of the image forming apparatus 1 is defined as 52 mm/sec, 3,500 V is applied to the pre-transcription charging roll 100, and the pre-transcription heating roll 150 is determined to be at 145° C. In addition, as the elastic hardness of the pre-transcription charging roll 100, 30° (ASKER C: SRIS 0101) is used. In addition, as the paper P, a paper of LETHAC 66 of 151 g/m$^2$ is used.

As shown in FIG. 9, according to the configuration without arranging the shielding member 180, when a distance between the middle transcription belt 41 and the pre-transcription charging roll 100 is not more than 6 mm, the defect of the image due to dispersal of the toner to the pre-transcription charging roll 100 is generated. In this case, an unintended electric field formed between the surface of the pre-transcription charging roll 100 and the middle transcription belt 41 depends on a distance and if such a distance is not more than 6 mm, the toner is dispersed because a coulomb force acting on the toner on the middle transcription belt 41 is large or electric discharge is caused or the like. On the contrary to this, it is considered that disperse of the toner is not generated because a coulomb force is small or electric discharge is not caused or the like when such a distance is not less than 8 mm. On the other hand, in the configuration arranging the shielding member 180, even when a distance between the middle transcription belt 41 and the pre-transcription charging roll 100 is 2 mm, the defect of the image due to toner dispersal to the pre-transcription charging roll 100 is not generated.

In addition, in a test shown in FIG. 9, under any condition, an excellent quality of an image that the transfer defect in the concave portion of the paper P is not visible is obtained.

As described above, according to the image forming apparatus 1 according to the present exemplary embodiment, for example, under an environment that a relative humidity is high or in the case of using a thick paper P that is difficult to evaporate water content sufficiently, the pre-transcription charging roll 100 and the pre-transcription heating roll 150 are moved along the conveying path of the paper P in a direction of the side of the secondary transcribing portion T2. Therewith, in the vicinity of the side facing to the side of the pre-transcription charging roll 100 of the middle transcription belt 41, the shielding member 180 for electrically shielding the middle transcription belt 41 and the pre-transcription charging roll 100 is arranged.

Thereby, it is unnecessary to increase a bias to be supplied from the pre-transcription charging power source 951 to the pre-transcription charging roll 100 or it is possible to use an economical and portable pre-transcription charging power source 951. In addition, the toner is prevented from transferred from the middle transcription belt 41 to the pre-transcription charging roll 100 and generation of the defect of the image due to toner dispersal is prevented.

Third Exemplary Embodiment

According to the first exemplary embodiment, in the conveying path between the resist roll 74 and the secondary transcribing portion T2, the configuration of arranging the pre-transcription charging roll 100 and the pre-transcription heating roll 150 is described. According to the third exemplary embodiment, the configuration of adjusting a bias to be supplied from the pre-transcription charging power source 951 to the pre-transcription charging roll 100 and a power to be supplied from the pre-transcription heater power source 952 to the halogen heater 152 of the pre-transcription heating roll 150 will be described. Further, the same configurations as the first exemplary embodiment are given the same reference numerals and marks and their detailed explanations are herein omitted.

Figure 10:
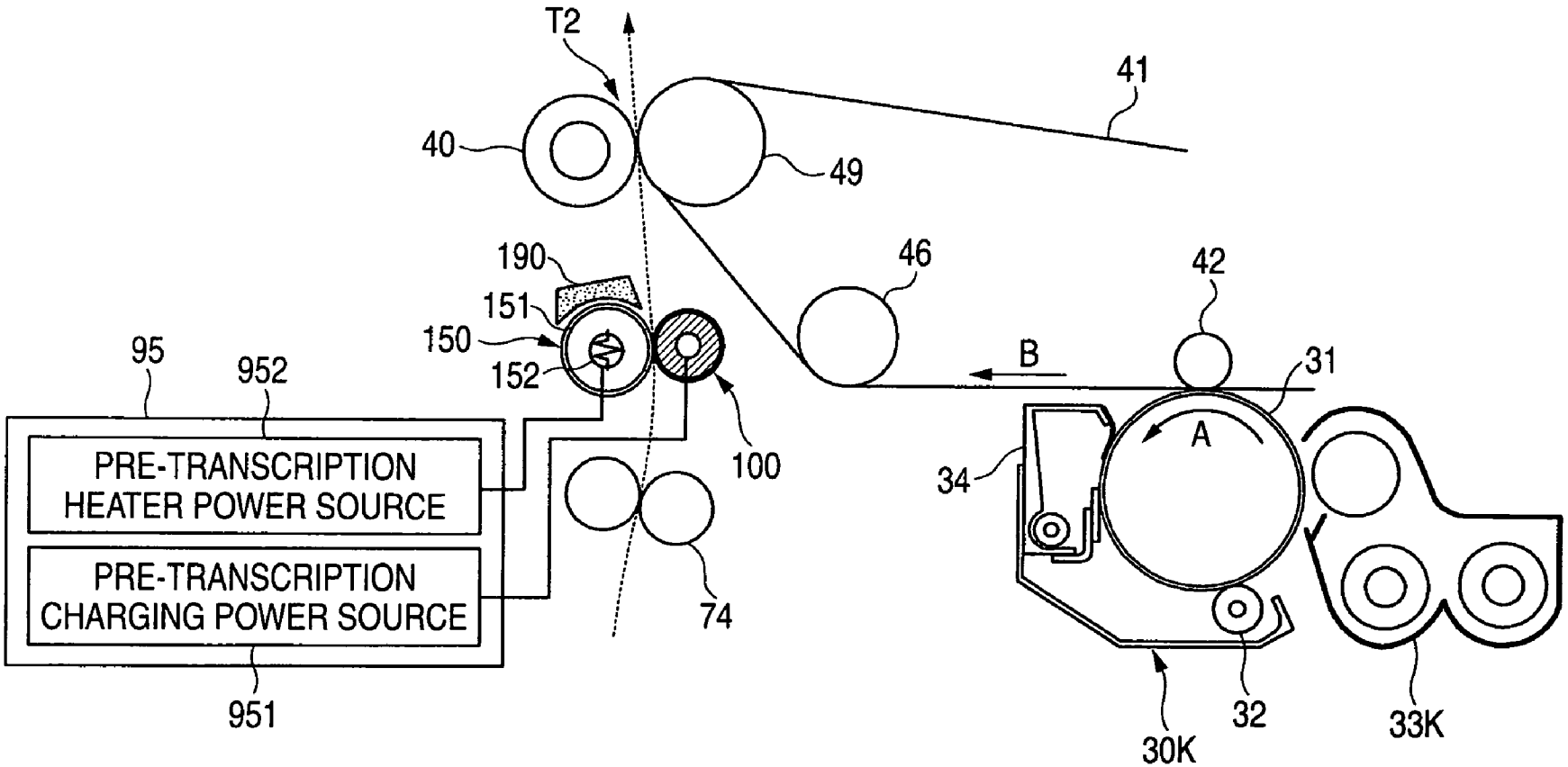
FIG. 10 is a view explaining a configuration of an area between the resist roll and the secondary transcribing portion T2.

FIG. 10 is a view explaining a configuration of an area between the rest roll 74 and the secondary transcribing portion T2 in the image forming apparatus 1 according to the present exemplary embodiment. The image forming apparatus 1 according to the present exemplary embodiment, as described with reference to the first exemplary embodiment, is configured so as to be able to adjust a bias to be supplied from the pre-transcription charging power source 951 to the pre-transcription charging roll 100 and a power to be supplied from the pre-transcription heater power source 952 to the halogen heater 152 of the pre-transcription heating roll 150.

Then, as shown in FIG. 10, the image forming apparatus 1 according to the present exemplary embodiment has a configuration such that a heat shielding member 190 for shielding a heat radiated from the pre-transcription heating roll 150 from being transmitted to the secondary transcription roll 40 is arranged between the pre-transcription heating roll 150 and the secondary transcription roll 40. The heat shielding member 190 in this case is configured by a material having a high heat shield property, for example, fluorine contained resin.

Then, according to the image forming apparatus 1 according to the present exemplary embodiment, by increasing a bias to be supplied from the pre-transcription charging power source 951 to the pre-transcription charging roll 100, for example, under an environment that a relative humidity is high or in the case of using a thick paper P that is difficult to evaporate water content sufficiently, a lower limit value forming a sufficient transfer electric field for transferring a toner image in the concave portion of the paper P is determined to be maintained in the secondary transcribing portion T2. In addition, by increasing a power to be supplied from the pre-transcription heater power source 952 to the halogen heater 152 of the pre-transcription heating roll 150, for example, under an environment that a relative humidity is high or in the case of using a thick paper P that is difficult to evaporate water content sufficiently, the resistance value of the paper P is adjusted so that a lower limit value forming a sufficient transfer electric field for transferring a toner image in the concave portion of the paper P is maintained in the secondary transcribing portion T2.

In this case, when a power to be supplied to the halogen heater 152 is increased, a heat radiated from the pre-transcription heating roll 150 may raise a temperature of the secondary transcription roll 40 that is arranged on the above of the pre-transcription heating roll 150. If a temperature of the secondary transcription roll 40 is raised, the resistance value of the secondary transcription roll 40 is varied, and in the secondary transcribing portion T2, a size of a transfer electric field formed between the secondary transcription roll 40 and the backup roll 49 to which the secondary transfer bias is applied is changed and the transfer unevenness may be generated.

Therefore, the image forming apparatus 1 according to the present exemplary embodiment is configured so that it is difficult for a heat radiated from the pre-transcription heating roll 150 to transmit to the secondary transcription roll 40 by arranging the heat shielding member 190 between the pre-transcription heating roll 150 and the secondary transcription roll 40. Thereby, even if a power to be supplied to the halogen heater 152 is raised, rise in a temperature of the secondary transcription roll 40 is prevented and generation of the transfer unevenness caused by variation of the resistance value of the secondary transcription roll 40 is prevented.

Here, FIG. 11 is a view comparing a quality of an image due to an unevenness of transfer when an amount of heat radiated from the pre-transcription heating roll 150 is changed by changing the surface temperature on the pre-transcription heating roll 150. In FIG. 11, as the paper P, a paper of LETHAC 66 of 203 g/m$^2$ having water content adjusted into 4% and 6% is used. A process speed of the image forming apparatus 1 is defined as 52 mm/sec, as a bias applied to the pre-transcription charging roll 100, in the case of LETHAC 66 adjusting water content into 4%, 3,500 V is applied to the pre-transcription charging roll 100, and in the case of LETHAC 66 adjusting water content into 6%, 4000 V is applied to the pre-transcription charging roll 100. In addition, as the elastic hardness of the pre-transcription charging roll 100, 30° (ASKER C: SRIS 0101) is used. In addition, the surface temperature of the pre-transcription heating roll 150 is determined to be at 125° C. in the case of LETHAC 66 adjusting water content into 4%, and the surface temperature of the pre-transcription heating roll 150 is determined to be at 145° C. in the case of LETHAC 66 adjusting water content into 6%. Then, in the configuration that the heat shielding member 190 is arranged and the configuration that the heat shielding member 190 is not arranged, respective LETHACS 66 are continuously scanned up to 50,000 sheets. Evaluation of a quality of an image due to unevenness of transfer is carried out by using a bond paper for each 500 sheets.

As shown in FIG. 11, according to the configuration that the heat shielding member 190 is not arranged, in a paper of LETHAC 66 that the surface temperature on the pre-transcription heating roll 150 is determined to be at 145° C. and a water content is 6%, when 10,000th sheet is scanned, a defect of an image due to unevenness of transfer is generated. On the other hand, in the configuration that the heat shielding member 190 is arranged, in a paper of LETHAC 66 that the surface temperature on the pre-transcription heating roll 150 is determined to be at 145° C. and a water content is 6%, even when 50,000th sheet is scanned, a defect of an image due to unevenness of transfer is not generated.

In addition, in the test that the surface temperature is determined to be at 125° C. shown in FIG. 11, in any of the configuration that the heat shielding member 190 is arranged and the configuration that the heat shielding member 190 is not arranged, an excellent quality of an image that the transfer defect in the concave portion of the paper P is not visible is obtained.

Further, depending on the paper P, it may be assumed that the paper P that is heated by the pre-transcription heating roll 150 indirectly raises a temperature of the secondary transcription roll 40. In order to treat such a case, the configuration that a non-contact cooling section for cooling the paper P is provided in the area among the pre-transcription charging roll 100, the pre-transcription heating roll 150, and the secondary transcribing portion T2 may be available.

As described above, the image forming apparatus 1 according to the present exemplary embodiment is configured such that a bias to be supplied from the pre-transcription charging power source 951 to the pre-transcription charging roll 100 and a power to be supplied from the pre-transcription heater power source 952 to the halogen heater 152 of the pre-transcription heating roll 150 can be adjusted for example, in the case that a relative humidity is high or in the case of using a thick paper P that is difficult to evaporate water content. Therewith, the heat shielding member 190 is arranged between the pre-transcription heating roll 150 and the secondary transcription roll 40.

Thereby, even in the case that a relative humidity is high or in the case of using a thick paper P that is difficult to evaporate water content sufficiently, it is possible to determine the lower limit value forming a sufficient transfer electric field for transferring a toner image in the concave portion of the paper P to be maintained in the secondary transcribing portion T2. In addition, rise in a temperature of the secondary transcription roll 40 is prevented and generation of the transfer unevenness caused by variation of the resistance value of the secondary transcription roll 40 is prevented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material charging apparatus comprising:

a pre-transcription charging section arranged between a transcribing section that transcribes a toner image retained by a toner image retaining body on a recording material having concavity and convexity and a conveying section that conveys the recording material to the transcribing section and is arranged closest to the transcribing section, the pre-transcription charging section charging the recording material that is to be conveyed to the transcribing section;

a voltage supplying section that supplies voltage of a polarity opposite to a charging polarity of the toner image retained in the toner image retaining body to the pre-transcription charging section; and a pre-transcription heating section that heats the recording material to be conveyed to the transcribing section, the pre-transcription heating section being arranged between the transcribing section and the conveying section (i) at a position opposed to the pre-transcription charging section or (ii) at a side of the conveying section rather than the pre-transcription charging section, wherein the pre-transcription charging section and the pre-transcription heating section are configured so as to be able to move between the transcribing section and the conveying section along a conveying direction of the recording material.

2. The recording material charging apparatus according to claim 1, wherein the pre-transcription charging section comprises a roll member that charges the recording material while contacting the recording material.

3. The recording material charging apparatus according to claim 2, wherein the roll member has an elastic hardness of from about 15° to about 30° in ASKER C (SRIS 0101).

4. An image forming apparatus comprising:

the recording material charging apparatus according to claim 1;

the toner image retaining body that retains the toner image; and the transcribing section that transcribes the toner image retained by the toner image retaining body on the recording material having concavity and convexity.

5. The recording material charging apparatus according to claim 1, wherein the pre-transcription charging section and the pre-transcription heating section are configured so as to be able to move to a position that is separated from the recording material.

6. An image forming apparatus comprising:

the recording material charging apparatus according to claim 1;

the toner image retaining body that retains the toner image; and the transcribing section that transcribes the toner image retained by the toner image retaining body on the recording material having concavity and convexity.

7. The image forming apparatus according to claim 6, wherein the pre-transcription charging section and the pre-transcription heating section are configured so that a relation that $\mu1<\mu2<\mu3$ is established in the case that a static friction coefficient between the pre-transcription charging section and the recording material is defined as $\mu1$; a static friction coefficient between the pre-transcription heating section and the recording material is defined as $\mu2$; and a static friction coefficient between the toner image retaining body and the recording material is defined as $\mu3$.

8. The image forming apparatus according to claim 6, further comprising:

a heat shielding member that prevents a heat from being transmitted from the pre-transcription heating section to the transcription section.

9. The image forming apparatus according to claim 6, wherein the pre-transcription charging section is arranged on a position such that the recording material charged by the pre-transcription charging section maintains a potential not less than a predetermined potential of the recording material when the recording material is conveyed to an arrangement position of the transcribing section.

10. The image forming apparatus according to claim 6, further comprising:

a shielding member that shields a space between the pre-transcription charging section and the toner image retaining body.

* * * * *